US010360852B2

(12) United States Patent
Kim et al.

(10) Patent No.: US 10,360,852 B2
(45) Date of Patent: Jul. 23, 2019

(54) ORGANIC LIGHT-EMITTING DISPLAY

(71) Applicant: LG DISPLAY CO., LTD., Seoul (KR)

(72) Inventors: Sangkyu Kim, Gyeonggi-do (KR); Sangpyo Hong, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 80 days.

(21) Appl. No.: 15/635,364

(22) Filed: Jun. 28, 2017

(65) Prior Publication Data

US 2018/0005581 A1 Jan. 4, 2018

(30) Foreign Application Priority Data

Jun. 30, 2016 (KR) ..... 10-2016-0082726

(51) Int. Cl.

| | |
|---|---|
| ***G09G 3/32*** | (2016.01) |
| ***G09G 3/3258*** | (2016.01) |
| ***G09G 3/3266*** | (2016.01) |
| ***G09G 3/3275*** | (2016.01) |

(52) U.S. Cl.

CPC ..... *G09G 3/3258* (2013.01); *G09G 3/3266* (2013.01); *G09G 3/3275* (2013.01); *G09G 2300/0426* (2013.01); *G09G 2300/0452* (2013.01); *G09G 2310/027* (2013.01); *G09G 2310/08* (2013.01); *G09G 2320/045* (2013.01); *G09G 2330/02* (2013.01); *G09G 2330/12* (2013.01)

(58) Field of Classification Search

CPC .... G09G 3/3275; G09G 3/3233; G09G 3/006; G09G 3/3258; G09G 2300/043; G09G 2300/0819

USPC ..... 345/76–78, 98, 100, 609

See application file for complete search history.

(56) References Cited

U.S. PATENT DOCUMENTS

2013/0162617 A1* 6/2013 Yoon ..... G09G 3/3291 345/211

2016/0155381 A1* 6/2016 Kwon ..... G09G 3/3233 345/215

* cited by examiner

*Primary Examiner* — Jennifer T Nguyen

(74) *Attorney, Agent, or Firm* — Morgan, Lewis & Bockius LLP

(57) ABSTRACT

An organic light-emitting display organic light-emitting display includes a display panel having a plurality of pixels, a plurality of data lines that are connected to the pixels, and a plurality of gate lines that are connected to the pixels; and a data drive circuit having a plurality of digital-to-analog converters configured to generate an image data voltage and a sensing data voltage to be applied to the pixels, a plurality of sensing units configured to sense an organic light-emitting diode (OLED) operating point voltage of the pixels, and a plurality of connecting switches configured to selectively connect the digital-to-analog converters and the sensing units to the data lines.

14 Claims, 13 Drawing Sheets

ORGANIC LIGHT-EMITTING DISPLAY

This application claims the priority of Korean Patent Application No. 10-2016-0082726, filed on Jun. 30, 2016, which is hereby incorporated herein by reference.

BACKGROUND

Technical Field

The present disclosure relates to an organic light-emitting display.

Discussion of the Related Art

An active-matrix organic light-emitting display comprises self-luminous organic light-emitting diodes (hereinafter, "OLEDs"), and typically has advantages of a fast response time, high luminous efficiency, high luminance, and wide viewing angle.

An OLED, which is a self-luminous device, typically includes an anode, a cathode, and organic compound layers formed between the anode and cathode. The organic compound layers may include a hole injection layer HIL, a hole transport layer HTL, an emission layer EML, an electron transport layer ETL, and an electron injection layer EIL. When a power supply voltage is applied to the anode and the cathode, a hole passing through the hole transport layer HTL and an electron passing through the electron transport layer ETL move to the emission layer EML, forming an exciton. As a result, the emission layer EML generates visible light.

In an organic light-emitting display, pixels each including an OLED and a driving TFT (thin-film transistor) may be arranged in a matrix, and the brightness of an image created by the pixels may be adjusted based on the grayscale of image data. The driving TFT may control the drive current flowing through the OLED based on the voltage applied between its gate electrode and source electrode. The amount of light emitted by the OLED may be determined by drive current, and the brightness of an image may be determined by the amount of light emitted by the OLED.

The OLED may deteriorate as the light-emitting time increases. Deterioration of the OLED may increase a threshold voltage (which may be termed an "operating point voltage") for turning on the OLED, and reduce luminous efficiency. The OLED's accumulated light-emitting time may vary from pixel to pixel, and therefore, OLED deterioration also may vary from pixel to pixel. The difference in OLED deterioration among pixels may cause brightness variation and lead to image sticking.

Due to this reason, organic light-emitting displays of the related art may employ deterioration compensation technology that detects deterioration by sensing an OLED operating point voltage and corrects image data by a correction gain to compensate for OLED deterioration. In a related art organic light-emitting display, a data driver IC (integrated circuit) may have a plurality of built-in sensing units for sensing an OLED operating point voltage, and the pixels and the sensing units may be connected together through reference lines.

A display panel may be additionally equipped with such reference lines to sense an OLED operating point voltage, which may be a primary factor for reduction of wiring design margin in the display panel. To reduce the number of reference lines, a structure has been proposed, in which a plurality of neighboring pixels may share a single reference line. With this structure, however, it may not be possible to sense each individual pixel that shares the reference line.

SUMMARY

Accordingly, embodiments of the present disclosure are directed to a display that substantially obviates one or more of the problems due to limitations and disadvantages of the related art.

An aspect of the present disclosure is to provide an organic light-emitting display which can easily achieve wiring design margin in a display panel by eliminating reference lines from the display panel and sensing an OLED operating point voltage through data lines.

Additional features and advantages of the disclosure will be set forth in the description that follows, and in part will be apparent from the description, or may be learned by practice of the disclosure. The objectives and other advantages of the disclosure will be realized and attained by the structure particularly pointed out in the written description and claims hereof as well as the appended drawings.

To achieve these and other aspects of the inventive concepts as embodied and broadly described, an example embodiment of the present disclosure may provide an organic light-emitting display, comprising a display panel having a plurality of pixels, a plurality of data lines that are connected to the pixels, and a plurality of gate lines that are connected to the pixels; and a data drive circuit having a plurality of digital-to-analog converters configured to generate an image data voltage and a sensing data voltage to be applied to the pixels, a plurality of sensing units configured to sense an organic light-emitting diode (OLED) operating point voltage of the pixels, and a plurality of connecting switches configured to selectively connect the digital-to-analog converters and the sensing units to the data lines.

It is to be understood that both the foregoing general description and the following detailed description are example and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the various principles of the disclosure. In the drawings.

DETAILED DESCRIPTION

Figure 1:
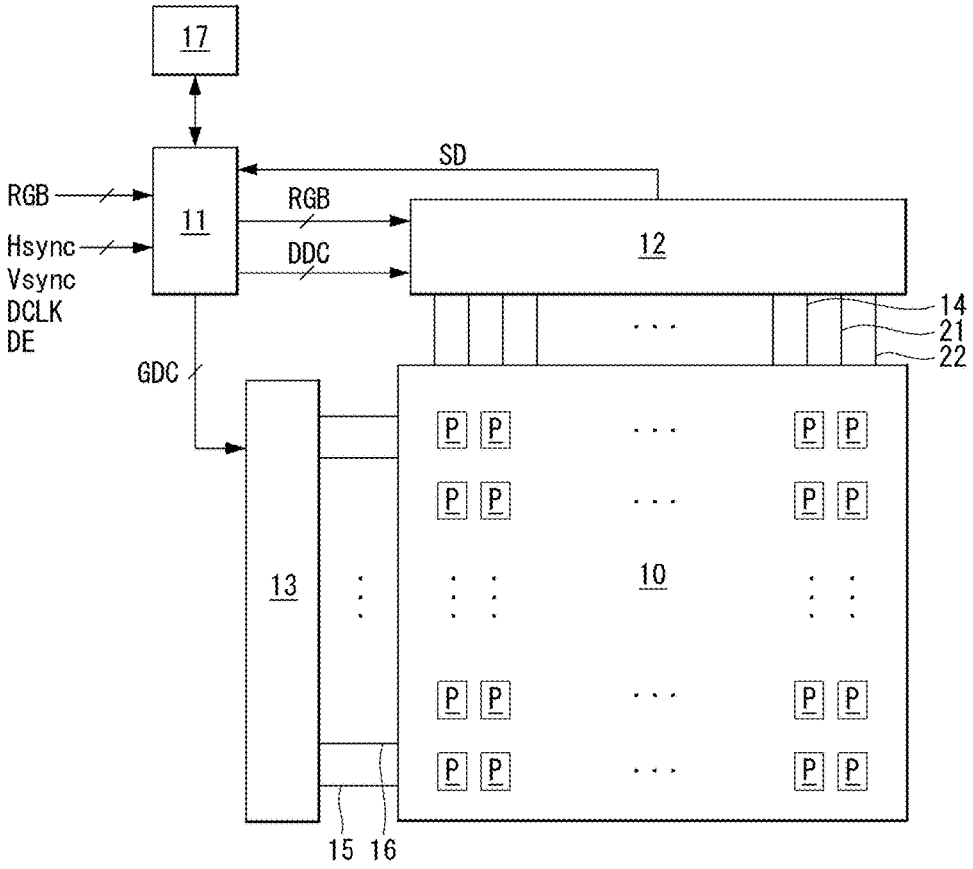
FIG. 1 shows an organic light-emitting display according to an example embodiment of the present disclosure.

Hereinafter, some embodiments of the present disclosure will be described in detail with reference to the accompanying illustrative drawings. In designating elements of the drawings by reference numerals, the same elements will be designated by the same reference numerals although they are shown in different drawings. Further, in the following description of the present disclosure, a detailed explanation of certain functions and configurations incorporated herein may have been merely for the sake of brevity.

The shapes, sizes, proportions, angles, numbers, etc. shown in the figures to describe the example embodiments of the present disclosure are merely examples and not limited to those shown in the figures. Like reference numerals denote like elements throughout the specification. In describing the present disclosure, detailed descriptions of related well-known technologies will be omitted to avoid unnecessarily obscuring the present disclosure. When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element. Thus, a first element discussed below could be termed a second element without departing from the technical spirit of the present disclosure.

Like reference numerals denote like elements throughout the specification.

The sizes and thicknesses of the components shown in the drawings are illustrated for explanatory convenience, but the present disclosure is not necessarily limited thereto.

The features of various example embodiments of the present disclosure may be combined with one another either partly or wholly, and may technically interact or work together in various ways. The example embodiments may be carried out independently or in combination with one another.

Hereinafter, various example embodiments of the present disclosure will be described in detail with reference to the accompanying drawings.

Figure 2A:
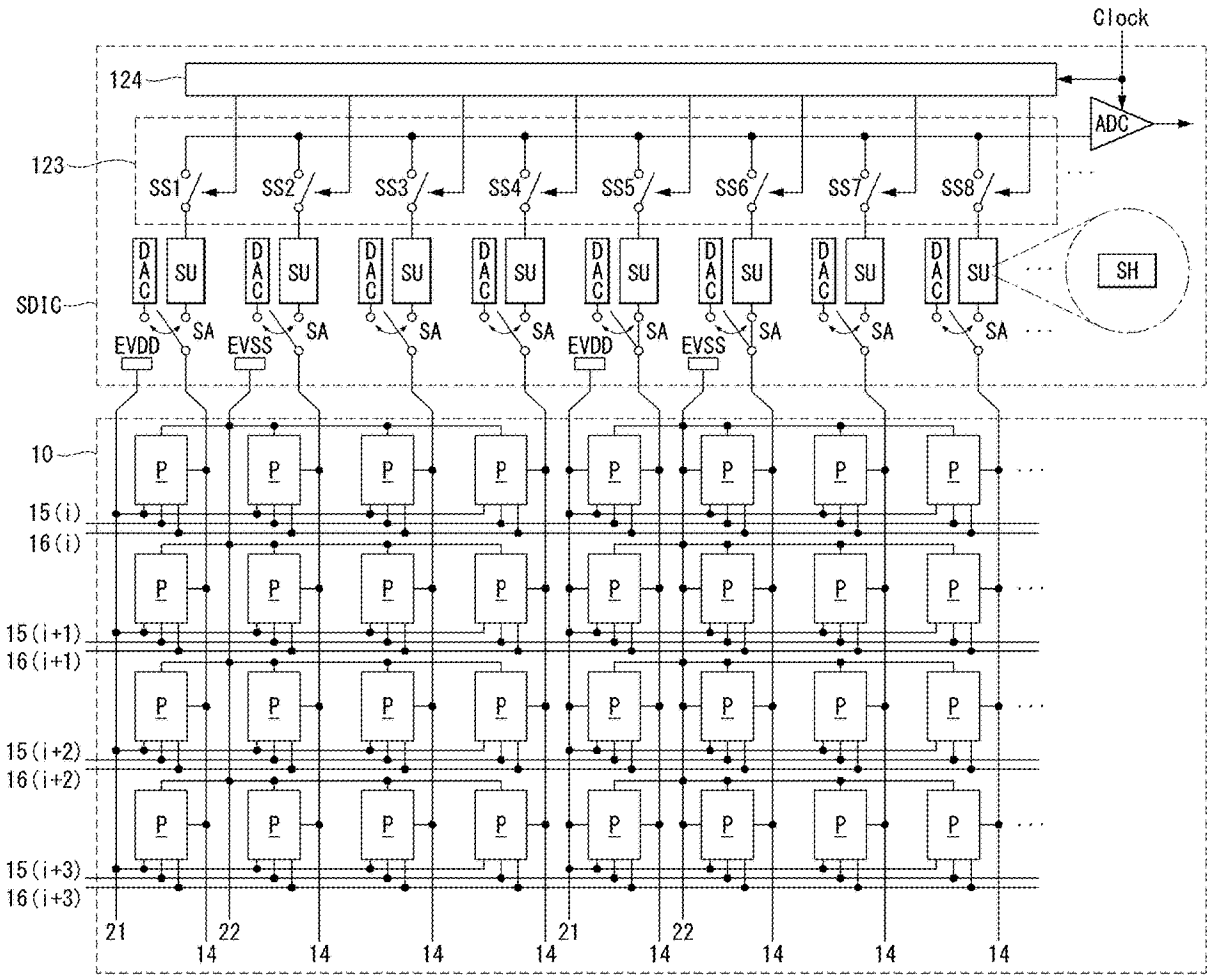
FIGS. 2A and 2B show configuration examples of a pixel array and a data driver IC according to an example embodiment of the present disclosure.
Figure 2B:
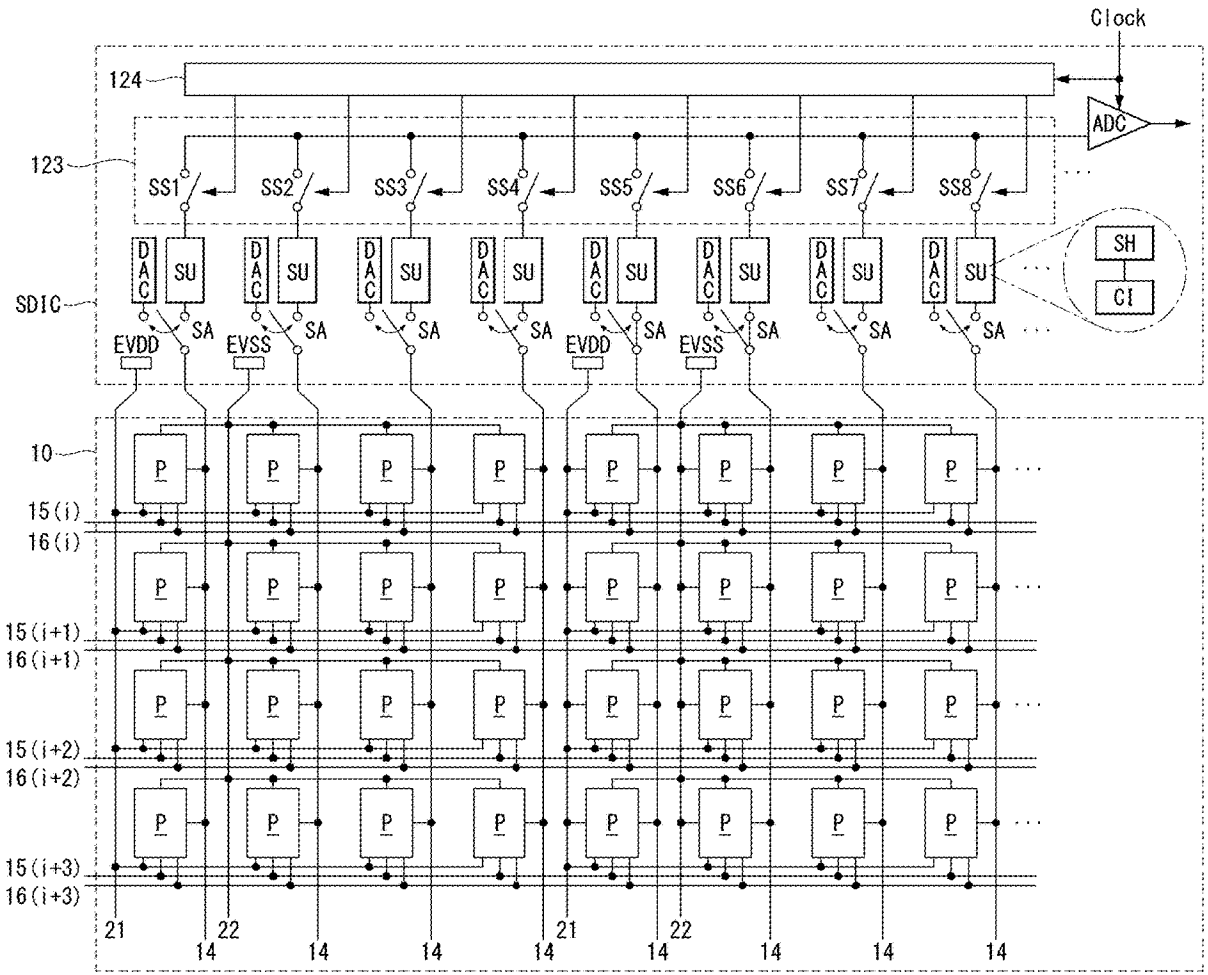
Figure 3:
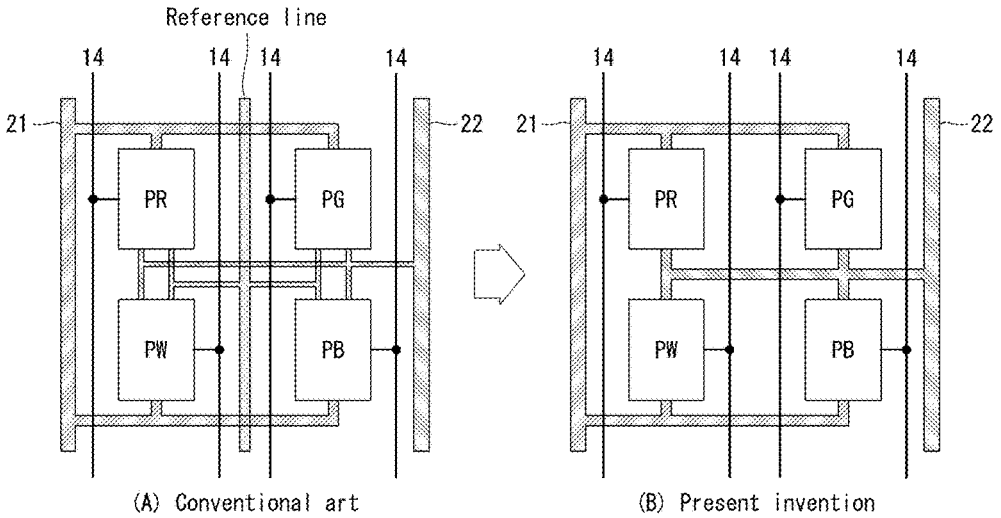
FIG. 3 shows a comparison of signal lines on a pixel array according to an example embodiment of the present disclosure and signal lines on a pixel array according to the related art.

FIG. 1 shows an organic light-emitting display according to an example embodiment of the present disclosure. FIGS. 2A and 2B show configuration examples of a pixel array and a data driver IC according to the present disclosure. FIG. 3 shows a comparison of signal lines on a pixel array according to the present disclosure and signal lines on a pixel array according to the related art.

With reference to FIGS. 1 to 3, an organic light-emitting display according to an example embodiment of the present disclosure comprises a display panel 10, a timing controller 11, a data drive circuit 12, a gate drive circuit 13, and a memory 17.

A plurality of data lines 14 and a plurality of gate lines 15 and 16 intersect each other on the display panel 10, and pixels P are arranged in a matrix at every intersection. The display panel 10 is additionally equipped with high-voltage power lines 21, which are parallel to the data lines 14 and apply a high-level driving voltage to the pixels P, and low-voltage power lines 22, which are parallel to the data lines 14 and apply a low-level driving voltage to the pixels P.

Each high-voltage power line 21 is connected to a first power input terminal EVDD in the data drive circuit 12, and may be shared by at least two pixels P neighboring in a direction (e.g., horizontal direction) in which the gate lines 15 and 16 extend. For example, each high-voltage power line 21 may be shared by four pixels neighboring in a horizontal direction, as shown in FIGS. 2A and 2B, or may be shared by two pixels neighboring in a horizontal direction, as shown in FIG. 3. In FIG. 3, PR denotes a first pixel for displaying red (R), PG denotes a second pixel for displaying green (G), PB denotes a third pixel for displaying blue (B), and PW denotes a fourth pixel for displaying white (W). The first to fourth pixels may make up a unit pixel. The unit pixel may be the smallest unit for producing various colors. The unit pixel may be in the form of 2 (pixels)*2 (pixels), as shown in FIG. 3, but is not limited to this. For example, the unit pixel may be in the form of 4 (pixels)*1 (pixel), as shown in FIGS. 2A and 2B.

Each low-voltage power line 22 is connected to a second power input terminal EVSS in the data drive circuit 12, and may be shared by at least two pixels P neighboring in a direction (e.g., horizontal direction) in which the gate lines 15 and 16 extend. For example, each low-voltage power line 22 may be shared by four pixels neighboring in a horizontal direction, as shown in FIGS. 2A and 2B, or may be shared by two pixels neighboring in a horizontal direction, as shown in FIG. 3.

By reducing the number of power lines 21 and 22 through such a sharing structure, the display panel 10 may have a better wiring design margin than the related art. In addition, in the case of bottom-emission organic light-emitting displays, the aperture ratio may be improved.

To further improve the wiring design margin and/or aperture ratio in the display panel 10, no reference lines may be formed on the display panel 10 of an example embodiment of the present disclosure. For example, FIG. 3 shows a comparison between an example embodiment and the related art, in which the display panel 10 of the example embodiment is not equipped with reference lines like in the related art. In example embodiments of the present disclosure, the wiring design margin and/or aperture ratio in the display panel 10 may be be further improved by eliminating the reference lines from the display panel 10 and sensing an OLED operating point voltage through the data lines 14.

The gate lines 15 and 16 may comprise a plurality of first gate lines 15 to which a first gate control signal is applied and a plurality of second gate lines 16 to which a second gate control signal is applied.

Figure 5:
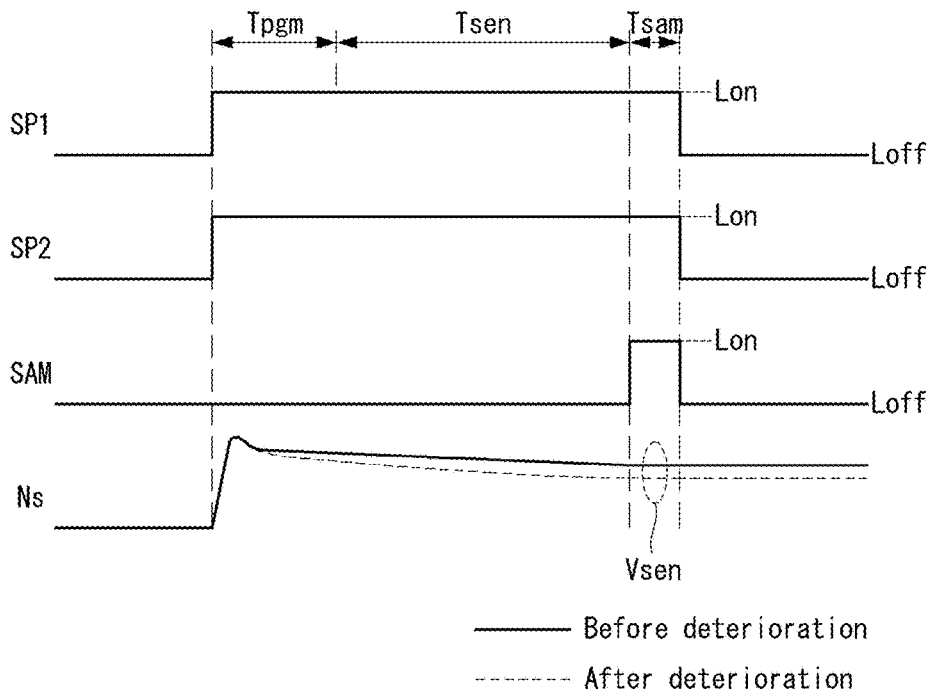
FIG. 5 is a waveform diagram showing control signals for a deterioration sensing method of an example embodiment of the present disclosure and potential variation at the source node.

In an example deterioration sensing method (e.g., direct sensing method) according to the present disclosure, as shown in FIG. 5, the first and second gate lines 15 and 16 may be integrated (e.g., as a single gate line) because the first and second gate control signals are the same. In this example, the wiring design margin and/or aperture ratio in the display panel 10 may be further improved. In the example direct sensing method, a specific voltage is applied to the OLED of each pixel P to cause the OLED to operate, and the remaining voltage after discharge through the OLED is directly sensed as an OLED operating point voltage.

Figure 7:
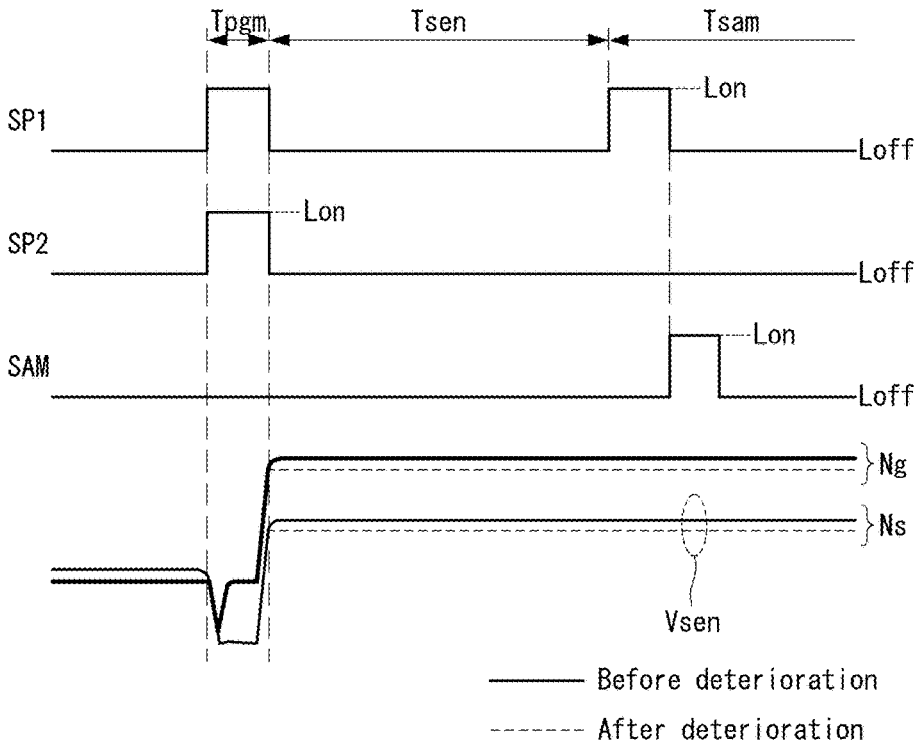
FIG. 7 is a waveform diagram showing control signals for another deterioration sensing method of an example embodiment of the present disclosure and potential variation at the gate node and the source node.

In another example sensing method (e.g., indirect sensing method) according to the present disclosure, as shown in FIG. 7, the first and second gate lines 15 and 16 may be individually separated because the first and second gate control signals are different. In the example indirect sensing method, a drain-source current flowing through the driving TFT causes the OLED to operate, and, based on the resulting voltage change on the OLED's anode, the OLED operating point voltage may be found indirectly.

Each pixel P may operate differently in normal operation (e.g., an image display operation) for writing input image data RGB to the display panel 10 and in sensing operation for measuring the OLED's operating point voltage. The sensing operation may be performed in a period in which the writing of image data RGB is stopped. For example, the sensing operation may be performed in a power-on sequence interval immediately after system power is applied, or in a power-off sequence interval immediately after system power is cut off.

The sensing operation is an operation for sensing OLED deterioration, which may be performed directly or indirectly. The sensing operation may include an operation of the data drive circuit 12 and gate drive circuit 13 under control of the timing controller 11.

With reference to FIGS. 2A and 2B, the data drive circuit 12 may include at least one data driver IC (integrated circuit) SDIC. The data driver IC SDIC may have a plurality of digital-to-analog converters (hereinafter, DACs), a plurality of sensing units SU, a plurality of connecting switches SA, an analog-to-digital converter (hereinafter, ADC), a MUX 123, and a shift register 124.

In a sensing operation, the DACs generate a data voltage for sensing under control of the timing controller 11, and in a normal operation, generate a data voltage for image display corresponding to input image data RGB under control of the timing controller 11.

The sensing units SU may operate only in a sensing operation and sense an OLED operating point voltage for the pixels P. The sensing units SU may be implemented as voltage sensing type or current sensing type. A voltage sensing type sensing unit SU may sense the voltage stored in the OLED's anode by using a sample & hold part SH as shown in FIG. 2A. The current sensing type sensing unit SU further comprises a current integrator CI connected to the front end of the sample & hold part SH as shown in FIG. 2B, and may sense a current flowing through the OLED and convert it to a voltage and produce the integrator's output voltage through the sample & hold part.

The connecting switches SA selectively connect the DACs and the sensing units SU to the data lines 14. In a normal operation, the connecting switches SA connect the DACs to the data lines 14 in a consecutive manner so that a data voltage for image display generated from the DACs is supplied to the data lines 14.

In a sensing operation, the connecting switches SA connect the DACs and the sensing units to the data lines in an alternating manner so that a data voltage for sensing generated from the DACs is supplied to the data lines 14, and an OLED operating point voltage sensed through the data lines 14 is supplied to the sensing units SU.

In the sensing operation, the shift register 124 generates a selection control signal (not shown) and sequentially turns on switches SS1 to SSk of the MUX 123. In the sensing operation, the MUX 123 selectively connects the sensing units SU to the ADC in response to a selection control signal. In the sensing operation, the ADC converts a sensing voltage fed from the sensing units SU to digital sensing data SD, and sends the sensing data SD to the timing controller 11.

The gate drive circuit 13 generates first and second gate control signals, corresponding to sensing and normal operations, respectively, under control of the timing controller 11, and may supply the first gate control signal to the first gate lines 15($i$) to 15($i$+3), and the second gate control signal to the second gate lines 16($i$) to 16($i$+3).

The timing controller 11 generates data control signals DDC for controlling the operation timing of the data drive circuit 12 and gate control signals GDC for controlling the operation timing of the gate drive circuit 13, based on timing signals, such as a vertical synchronization signal Vsync, a horizontal synchronization signal Hsync, a dot clock signal DCLK, and a data enable signal DE. The timing controller 11 may distinguish normal operation and sensing operation based on a driving power enable signal, a vertical synchronization signal, a data enable signal, etc., and may generate a data timing control signal DDC and a gate timing control signal GDC differently for each type of operation.

The timing controller 11 may preset a relation equation between the current flowing through the driving TFT and the OLED operating point voltage and store it in a first region of the memory 17. In a sensing operation, the timing controller 11 may update and keep first and second sensing data SD1 and SD2 sent from the data drive circuit 12 in a second region of the memory 17 and correct the second sensing data SD2 by the preset relation equation, thereby improving the accuracy of the second sensing data SD2 according to the indirect sensing method.

In the sensing operation, the timing controller 11 updates the sensing data SD sent from the data drive circuit 12 and stores it in the memory 17, and compares the updated sensing data SD with a preset initial sensing value. The initial sensing value is set at the time of product shipment, and corresponds to the OLED's operating point voltage before deterioration. The timing controller 11 reads out a deterioration compensation value from a preset compensation value table (e.g., look-up table) by using the difference between the updated sensing data SD and the initial sensing value as a read address. Based on the read-out deterioration compensation value, the timing controller 11 may modulate input image data RGB for image display and then send the modulated data to the data drive circuit 12 for normal operation.

Figure 4:
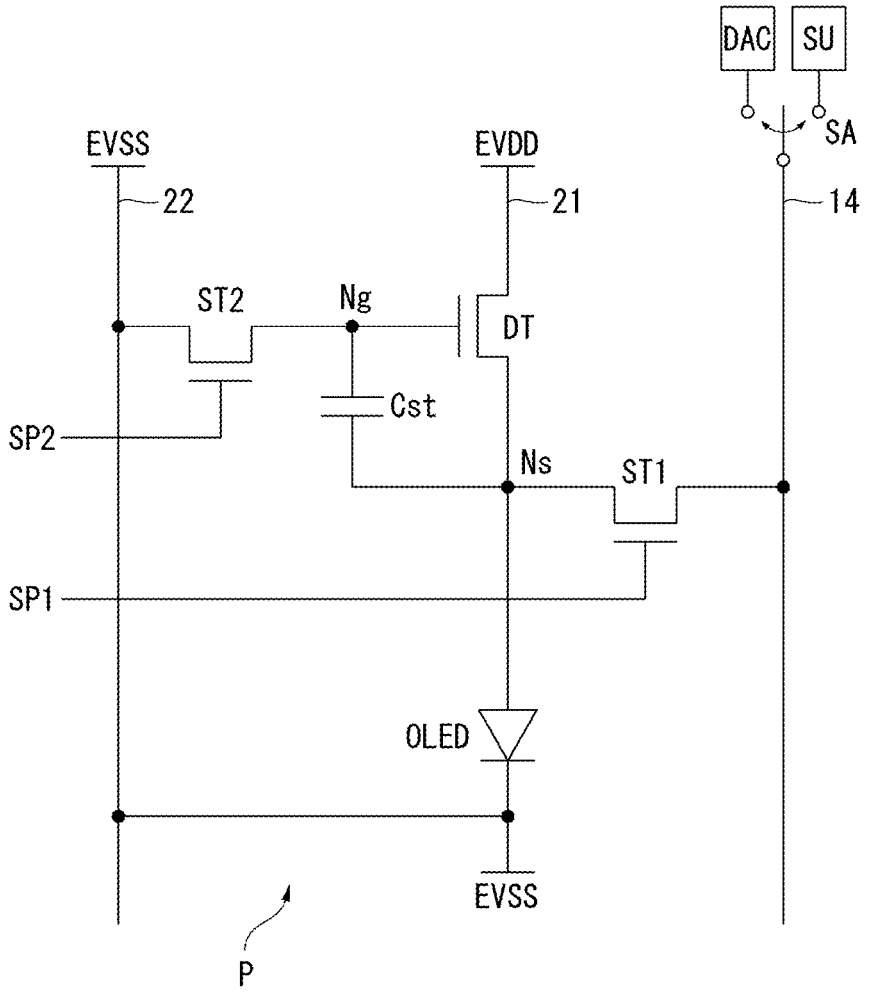
FIG. 4 shows an equivalent circuit diagram of a pixel included in the pixel array according to an example embodiment of the present disclosure.

FIG. 4 shows an equivalent circuit diagram of a pixel P included in the pixel array according to an example embodiment of the present disclosure.

With reference to FIG. 4, the pixel P may include an OLED, a driving TFT (thin-film transistor) DT, a storage capacitor Cst, a first switching TFT ST1, and a second switching TFT ST2.

The OLED has an anode connected to a source node Ns, a cathode connected to a second power input terminal EVSS, and organic compound layers located between the anode and the cathode.

The driving TFT DT controls the amount of drive current fed to the OLED based on a gate-source voltage. The driving TFT DT has a gate electrode connected to a gate node Ng, a drain electrode connected to a first power input terminal EVDD, and a source electrode connected to the source node Ns.

The storage capacitor Cst is connected between the gate node Ng and the source node Ns and maintains the gate-source voltage of the driving TFT DT for a desired amount of time.

The first switching TFT ST1 turns on/off in response to a first gate control signal SP1, and has a drain electrode connected to a data line 14 and a source electrode connected to the source node Ns. A gate electrode of the first switching TFT ST1 is connected to a first gate line 15 to which the first gate control signal SP1 is applied.

The second switching TFT ST2 turns on/off in response to a second gate control signal SP2, and has a drain electrode connected to the second power input terminal EVSS and a source electrode connected to the gate node Ng. A gate electrode of the second switching TFT ST2 is connected to a second gate line 16 to which the second gate control signal SP2 is applied.

Figure 6A:
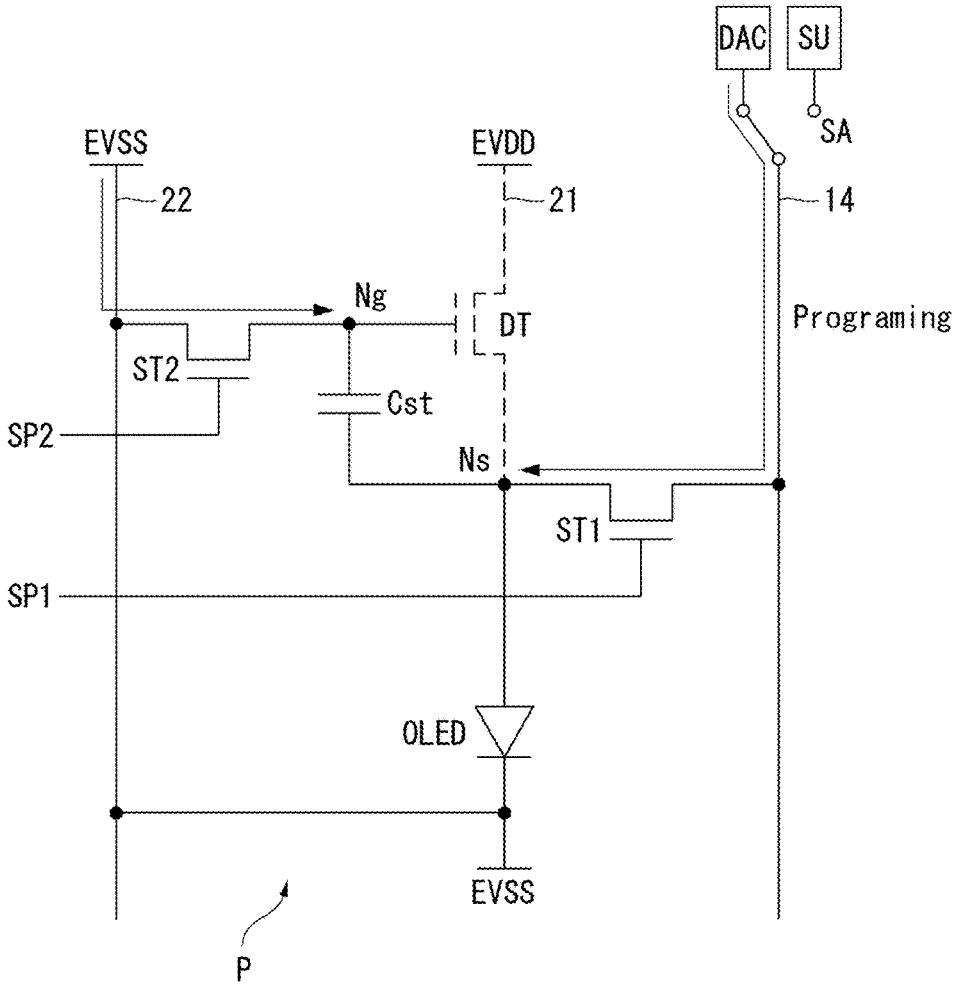
FIGS. 6A, 6B, and 6C are equivalent circuit diagrams of a pixel in a programming period, sensing period, and sampling period of FIG. 5.
Figure 6B:
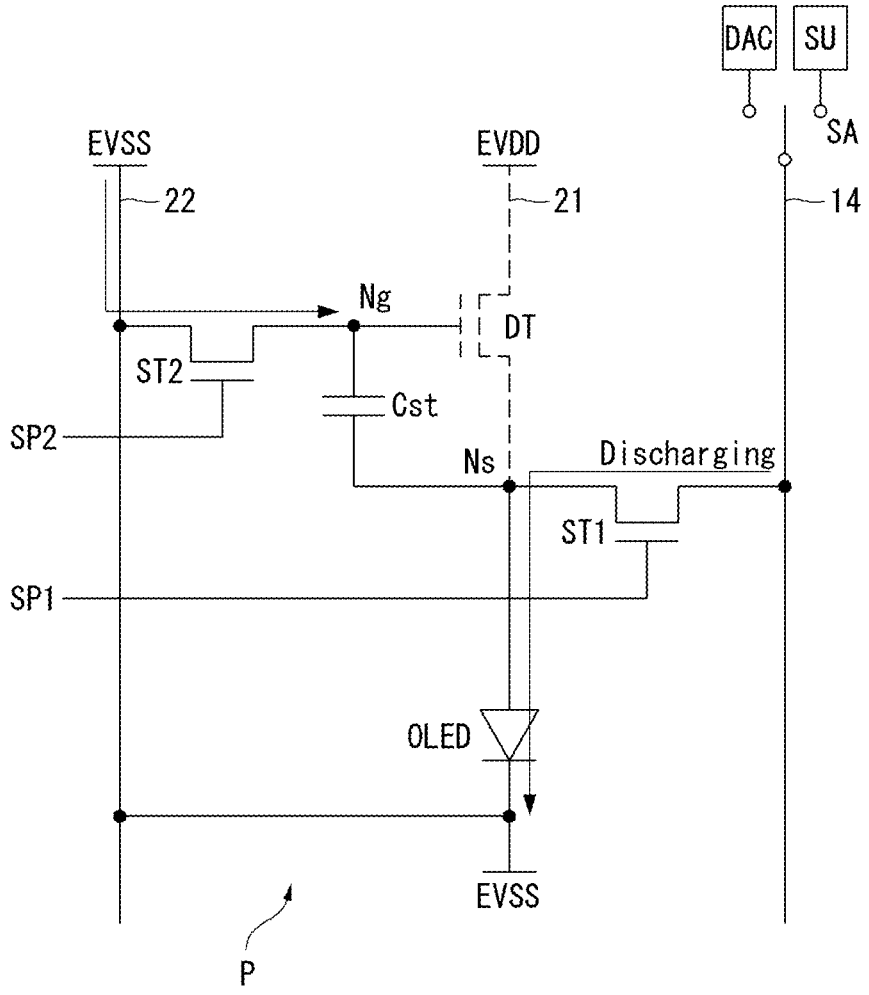
Figure 6C:
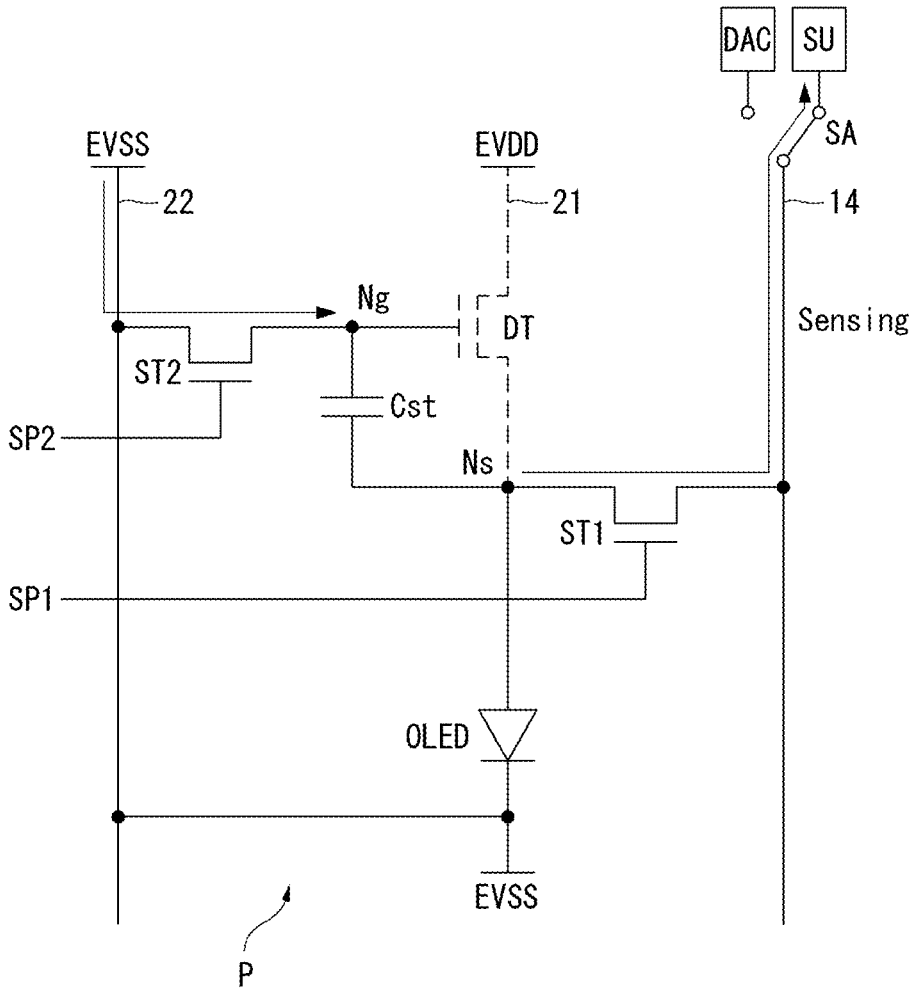

FIG. 5 is a waveform diagram showing control signals for an example direct sensing method of the present disclosure and potential variation at the source node. FIGS. 6A, 6B, and 6C are equivalent circuit diagrams of a pixel in a programming period, sensing period, and sampling period of FIG. 5.

In the direct sensing method of FIG. 5 according to an example of the present disclosure, the first and second gate control signals SP1 and SP2 are the same, and a single gate line may be used instead of the first and second gate lines 15 and 16.

One sensing period for the direct sensing method may comprise a programming period Tpgm, a sensing period Tsen, and a sampling period Tsam, which occur consecutively. In the programming period Tpgm, sensing period Tsen, and sampling period Tsam, the first and second gate control signals SP1 and SP2 are maintained at ON level Lon, and therefore the first and second switching TFTs ST1 and ST2 are kept turned on.

With reference to FIGS. 5 and 6A, in the programming period Tpgm, a low-level driving voltage is applied from the second power input terminal EVSS to the gate node Ng, and a data voltage for sensing is applied from a DAC to the source node Ns. To this end, a connecting switch SA in the data drive circuit 12 connects a data line 14 to the DAC. The data voltage for sensing is set higher than the low-level driving voltage—for example, high enough to turn on the OLED. Accordingly, in the programming period Tpgm, the driving TFT DT is programmed to turn off, and the OLED is programmed to turn on.

With reference to FIGS. 5 and 6B, in the sensing period Tsen, the low-level driving voltage from the second power input terminal EVSS continues to be applied to the gate node Ng, and the source node Ns is disconnected from the DAC. To this end, the connecting switch SA in the data drive circuit 12 cuts off the connection between the data line 14 and the DAC and puts the data line 14 into a floating state. Because current flows through the OLED in the sensing period Tsen, the data voltage for sensing which is stored in the source node Ns and the data line 14 is gradually discharged by the current flowing through the OLED, and as a result, converges to the OLED's operating point voltage (the voltage for turning on the OLED). The OLED's operating point voltage varies depending on the degree of deterioration in the OLED, and therefore the voltage of the source node Ns also varies. As the OLED deterioration progresses, the voltage of the source node Ns may decrease.

With reference to FIGS. 5 and 6C, in the sampling period Tsam, the low-level driving voltage from the second power input terminal EVSS continues to be applied to the gate node Ng, and the source node Ns is connected to a sensing unit SU. To this end, the connecting switch SA in the data drive circuit 12 connects the data line 14 to the sensing unit SU. In the sampling period Tsam, the voltage of the source node Ns is applied to the sensing unit SU and sensed as the OLED's operating point voltage. The sensing unit SU senses the voltage of the source node Ns as the OLED's operating point voltage—e.g., a sensing voltage Vsen—while a sampling control signal SAM is applied at ON level Lon.

Figure 8A:
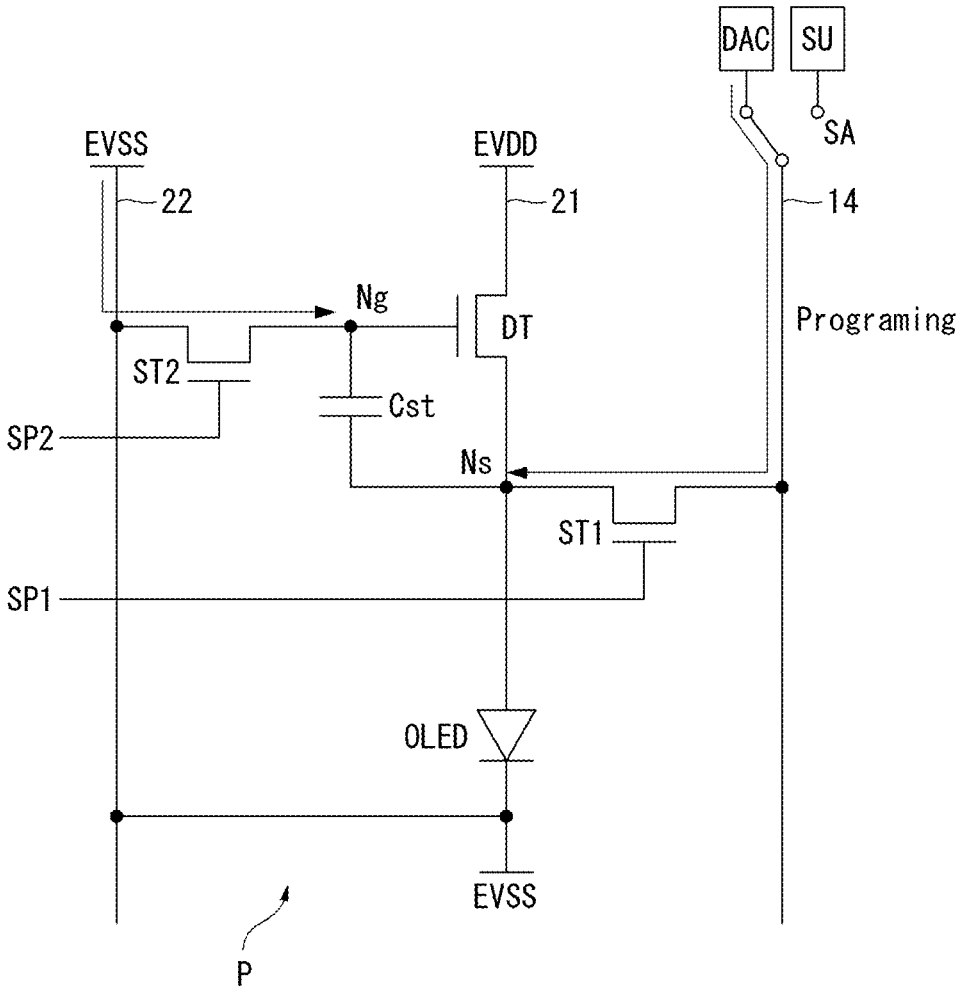
FIGS. 8A, 8B, and 8C are equivalent circuit diagrams of a pixel in a programming period, sensing period, and sampling period of FIG. 7.
Figure 8B:
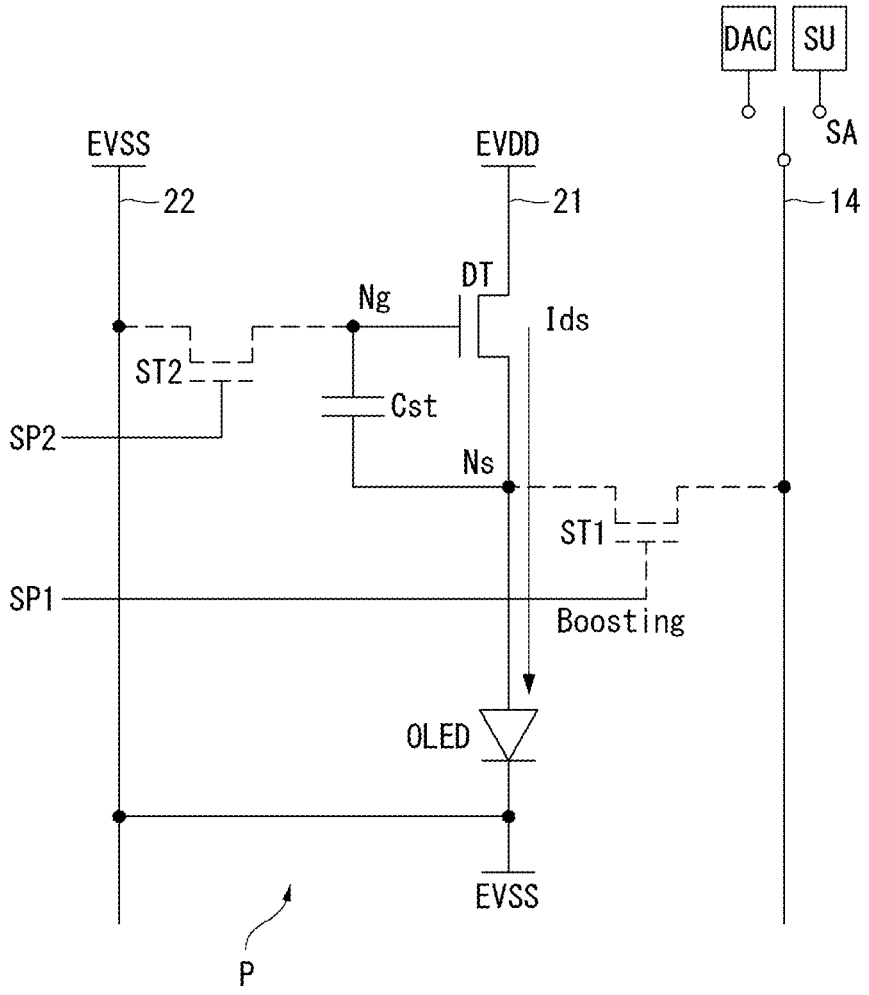
Figure 8C:
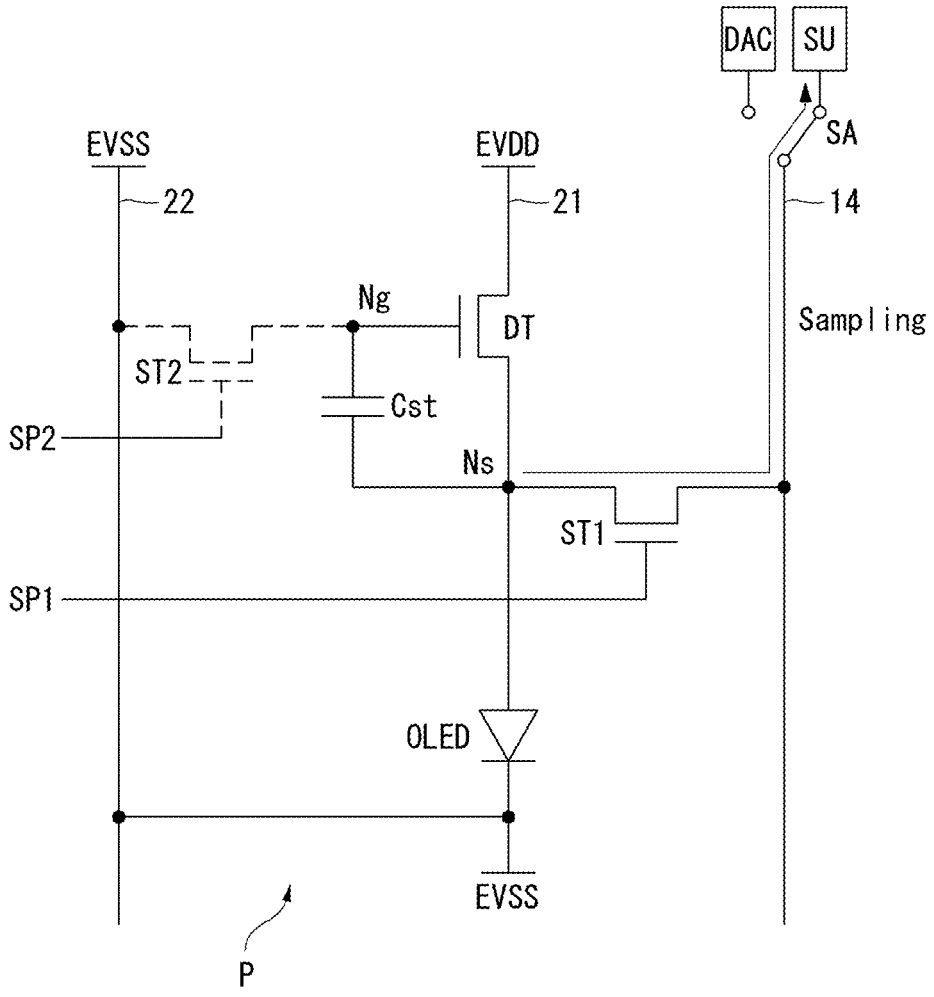

FIG. 7 is a waveform diagram showing control signals for another example deterioration sensing method of the present disclosure and potential variation at the gate node and the source node. FIGS. 8A, 8B, and 8C are equivalent circuit diagrams of a pixel in a programming period, sensing period, and sampling period of FIG. 7.

In the example indirect sensing method of FIG. 7 according to the present disclosure, the first and second gate control signals SP1 and SP2 are different, and the first and second gate lines 15 and 16 may be separated from each other.

One sensing period for the indirect sensing method may comprise a programming period Tpgm, a sensing period Tsen, and a sampling period Tsam, which occur consecutively. In the programming period Tpgm, the first and second switching TFTs ST1 and ST2 turn on because the first and second gate control signals SP1 and SP2 are all maintained at ON level Lon. In the sensing period Tsen, the first and second switching TFTs ST1 and ST2 turn off because the first and second gate control signals SP1 and SP2 are all maintained at OFF level Loff. In the sampling period Tsam, the first switching TFT ST1 is turned on and then turned off because the first gate control signal SP1 changes from ON level Lon to OFF level Loff, and the second switching TFT ST2 is kept turned off because the second gate control signal SP2 is maintained at OFF level Loff.

With reference to FIGS. 7 and 8A, in the programming period Tpgm, a low-level driving voltage is applied from the second power input terminal EVSS to the gate node Ng, and a data voltage for sensing is applied from a DAC to the source node Ns. To this end, a connecting switch SA in the data drive circuit 12 connects a data line 14 to the DAC. The data voltage for sensing needs to be sufficiently lower than the low-level driving voltage so as to meet the condition for turning on the driving TFT DT and the condition for turning off the OLED. That is, the data voltage for sensing needs to be sufficiently lower than the low-level driving voltage because the difference between the low-level driving voltage and the data voltage for sensing should be greater than the threshold voltage of the driving TFT DT. Accordingly, in the programming period Tpgm, the driving TFT DT is programmed to turn on, and the OLED is programmed to turn off.

With reference to FIGS. 7 and 8B, in the sensing period Tsen, the gate node Ng and the source node Ns are in a floating state, whereas the gate-source voltage of the driving TFT DT is maintained at the programmed level by the storage capacitor Cst. As a consequence, current Ids flows through the driving TFT DT in the sensing period Tsen. Due to this current Ids, the voltage of the source node Ns rises from the data voltage for sensing to the OLED operating point voltage. The voltage of the gate node Ng coupled to the source node Ns also rises to a voltage higher than the low-level voltage, affected by the rise in potential at the source node. The OLED's operating point voltage varies depending on the degree of deterioration in the OLED, and therefore the voltage of the source node Ns also varies. As the OLED deterioration progresses, the voltage of the source node Ns decreases and therefore the voltage of the gate node Ng also decreases.

With reference to FIGS. 7 and 8C, in the sampling period Tsam, the gate node Ng is disconnected from the second power input terminal EVSS and goes into a floating state, and the source node Ns is connected to a sensing unit SU. To this end, the connecting switch SA in the data drive circuit 12 connects the data line 14 to the sensing unit SU. In the sampling period Tsam, the voltage of the source node Ns is applied to the sensing unit SU and sensed as the OLED's operating point voltage. The sensing unit SU senses the voltage of the source node Ns as the OLED's operating point voltage—that is, a sensing voltage Vsen—while a sampling control signal SAM is applied at ON level Lon.

As stated above, example embodiments of the present disclosure may easily achieve wiring design margin in a display panel by eliminating reference lines from the display panel and sensing an OLED operating point voltage through data lines.

Moreover, example embodiments of the present disclosure may further achieve wiring design margin by designing power lines in such a way as to be shared by a plurality of pixels.

Furthermore, example embodiments of the present disclosure may further achieve wiring design margin by connecting only a single gate line to each pixel, because an OLED operating point voltage is sensed through data lines.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. An organic light-emitting display, comprising:

a display panel having a plurality of pixels, a plurality of data lines that are connected to the pixels, and a plurality of gate lines that are connected to the pixels; and a data drive circuit having:

a plurality of digital-to-analog converters configured to generate an image data voltage and a sensing data voltage to be applied to the pixels, a plurality of sensing units configured to sense an organic light-emitting diode (OLED) operating point voltage of the pixels, and a plurality of connecting switches configured to selectively connect the digital-to-analog converters and the sensing units to the data lines, wherein the display panel further includes high-voltage power lines and low-voltage power lines, wherein the high-voltage power lines are connected to a first power input terminal for supplying a high-level driving voltage to the pixels, and wherein the low-voltage power lines are connected to a second power input terminal for supplying a low-level driving voltage to the pixels, wherein each pixel comprises:

a driving thin-film transistor (TFT) having a drain electrode connected to the first power input terminal, a gate electrode connected to a gate node, and a source electrode connected to a source node;

an OLED having an anode connected to the source node and a cathode connected to the second power input terminal;

a first switching TFT having a drain electrode connected to any one of the data lines and a source electrode connected to the source node, wherein the first switching TFT turns on/off in response to a first gate control signal;

a second switching TFT having a drain electrode connected to the second power input terminal and a source electrode connected to the gate node, wherein the second switching TFT turns on/off in response to a second gate control signal; and a storage capacitor connected between the gate node and the source node.

2. The organic light-emitting display of claim 1, wherein the digital-to-analog converters supply the image data voltage to the data lines in an image display operation.

3. The organic light-emitting display of claim 2, wherein the connecting switches connect the digital-to-analog converters to the data lines in the image display operation.

4. The organic light-emitting display of claim 1, wherein the digital-to-analog converters supply the sensing data voltage to the data lines for sensing the OLED operating point voltage of the pixels.

5. The organic light-emitting display of claim 4, wherein the connecting switches connect the digital-to-analog converters to the data lines for supplying the sensing data voltage, and connect the sensing units to the data lines for sensing the OLED operating point voltage of the pixels.

6. The organic light-emitting display of claim 1, wherein the high-voltage power lines are parallel to the data lines, and wherein the low-voltage power lines are parallel to the data lines.

7. The organic light-emitting display of claim 6, wherein each high-voltage power line is shared by a plurality of the pixels neighboring in a direction in which the gate lines extend, and wherein each low-voltage power line is shared by a plurality of the pixels neighboring in the direction in which the gate lines extend.

8. The organic light-emitting display of claim 1, the display further comprising:

a gate drive circuit configured to generate the first gate control signal and the second gate control signal.

9. The organic light-emitting display of claim 1, wherein a programming period, a sensing period, and a sampling period occur consecutively while the first and second gate control signals are maintained at an ON level by the gate drive circuit, wherein the connecting switches in the data drive circuit connect the data lines to the digital-to-analog converters generating the sensing data voltage in the programming period, put the data lines into a floating state in the sensing period, and connect the data lines to the sensing units in the sampling period.

10. The organic light-emitting display of claim 1, wherein the first and second gate control signals are all maintained at ON level by the gate drive circuit during a programming period, then the first and second gate control signals are all maintained at OFF level by the gate drive circuit during a sensing period, and then the first gate control signal changes from ON level to OFF level and the second gate control signal is maintained at OFF level by the gate drive circuit during a sampling period, wherein the connecting switches in the data drive circuit connect the data lines to the digital-to-analog converters generating the sensing data voltage in the programming period, put the data lines into a floating state in the sensing period, and connect the data lines to the sensing units in the sampling period.

11. The organic light-emitting display of claim 1, wherein the sensing data voltage is higher than the low-level driving voltage and is high enough to turn on the OLED.

12. The organic light-emitting display of claim 1, wherein the sensing data voltage is lower than the low-level driving voltage.

13. The organic light-emitting display of claim 1, wherein the sensing units further comprise a sample and hold part, and wherein the sensing units sense the voltage stored in an anode of an OLED by using the sample and hold part.

14. The organic light-emitting display of claim 1, wherein the sensing units further comprise a sample and hold part and a current integrator connected to a front end of the sample and hold part, wherein the current integrator senses a current flowing through an OLED and converts the current to a voltage, and wherein the sensing units sense the voltage of the current integrator through the sample and hold part.

* * * * *